US007850381B2

(12) United States Patent
Izawa et al.

(10) Patent No.: US 7,850,381 B2
(45) Date of Patent: Dec. 14, 2010

(54) MECHANICAL PENCIL

(75) Inventors: Hirotake Izawa, Yokohama (JP); Takeshi Kobayashi, Yokohama (JP); Kyo Nakayama, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 12/747,984

(22) PCT Filed: Dec. 18, 2008

(86) PCT No.: PCT/JP2008/073048

§ 371 (c)(1),
(2), (4) Date: Jun. 14, 2010

(87) PCT Pub. No.: WO2009/084446

PCT Pub. Date: Jul. 9, 2009

(65) Prior Publication Data

US 2010/0266325 A1 Oct. 21, 2010

(30) Foreign Application Priority Data

Dec. 28, 2007 (JP) ..... 2007-339075

(51) Int. Cl.
*B43K 21/22* (2006.01)

(52) U.S. Cl. ..... 401/93; 401/92; 401/74

(58) Field of Classification Search ..... 401/74, 401/92–94

See application file for complete search history.

(56) References Cited

U.S. PATENT DOCUMENTS

| | | | | |
|---|---|---|---|---|
| 6,481,908 | B2 * | 11/2002 | Lychwick | 401/92 |
| 6,702,495 | B1 * | 3/2004 | Lychwick | 401/92 |
| 7,654,763 | B2 | 2/2010 | Izawa et al. | |
| 2009/0180824 | A1 | 7/2009 | Izawa et al. | |

FOREIGN PATENT DOCUMENTS

| | | |
|---|---|---|
| JP | 54-025339 U | 2/1979 |
| JP | 56-019382 U | 2/1981 |
| JP | 59-107286 U | 7/1984 |

(Continued)

OTHER PUBLICATIONS

International Search Report of PCT/JP2008/073048, Mailing Date of Jan. 20, 2009.

*Primary Examiner*—David J Walczak
(74) *Attorney, Agent, or Firm*—Westerman, Hattori, Daniels & Adrian, LLP

(57) ABSTRACT

A chuck (4) for grasping a writing lead and a rotor (6) arranged to be movable together in a direction of rotation and an axial direction within a body cylinder (1). A rotational drive mechanism for the writing lead is formed such that first and second cam faces (6*a*) and (6*b*) are respectively formed at one end face and another end face of the rotor in the axial direction, and first and second fixed cam faces (13*a*) and (14*a*) are arranged on the body cylinder side to face the above-mentioned first and second cam faces respectively. Retreat operation and forward movement (cushion action) of the writing lead by writing pressure are provided with a damping effect by sticky grease (19) interposed between a stopper (16) and a torque canceller (17). As a result, a sense of uncomforting, when writing, generated in conjunction with the cushion action can be reduced.

6 Claims, 9 Drawing Sheets

FOREIGN PATENT DOCUMENTS

| | | | |
|---|---|---|---|
| JP | 10-016479 | A | 1/1998 |
| JP | 10-329485 | A | 12/1998 |
| JP | 11-099795 | A | 4/1999 |
| JP | 3882272 | B2 | 2/2007 |
| JP | 3885315 | B2 | 2/2007 |
| WO | 2007142135 | A1 | 12/2007 |

* cited by examiner

MECHANICAL PENCIL

TECHNICAL FIELD

The present invention relates to a mechanical pencil which can rotate a writing lead (refill lead) by writing pressure.

BACKGROUND ART

In the case of writing with a mechanical pencil, it is generally often the case that the mechanical pencil is not used in a situation where a body cylinder is perpendicular to a writing side (page), but used in a situation where the body cylinder is somewhat inclined to the writing side. In the case where the body cylinder is thus inclined for writing, there arises a phenomenon that a drawn line becomes bold as compared with that in the beginning, since the writing lead may locally abrade (partially wear) as the writing proceeds. Further, not only the drawn line changes in boldness, but also there arises a phenomenon that the drawn line changes in thickness (drawn line becomes thin) as the writing proceeds, since a contact area of the writing lead changes with respect to the writing side.

In order to avoid the above-mentioned problem, when the writing is carried out with the body cylinder being rotated, then it is possible to avoid such a problem that, as described above, the drawn line becomes bold as it is drawn, since a sharper side of the writing lead is rotatably in contact with the page when writing. However, when you write down with the body cylinder being rotated, there arises a problem in that operation of re-holding the body cylinder is required while the writing proceeds, leading to considerable reduction in writing efficiency.

In that case, it is not impossible to write down by re-holding the body cylinder and rotating it in a stepwise manner, in the case where exterior of the body cylinder is formed to be cylindrical. However, in the case of the mechanical pencil whose exterior may not be cylindrical and which may be designed to have a projection in the middle or which is a side-knock-type mechanical pencil, it is difficult to write by re-holding the body cylinder to be rotated in a stepwise manner as described above.

In order to solve such a problem, as described above, patent documents 1 and 2, etc., disclose a mechanical pencil arranged such that a chuck for gripping a writing lead may be retreated by writing pressure, and having a rotational drive mechanism in which the above-mentioned writing lead together with the above-mentioned chuck is rotated by way of the retreat operation.

Patent Document 1: Japanese Patent No. 3882272

Patent Document 2: Japanese Patent No. 3885315

DISCLOSURE OF THE INVENTION

Object of the Invention

Incidentally, according to the mechanical pencil disclosed in the above-mentioned patent documents 1 and 2, vertical projections and vertical recesses are arranged alternately in a body cylinder, and a cam part is formed annularly which has slopes each being across the vertical projection and recess. Further, a rotor having formed thereon projections at intervals in a circumferential direction is accommodated in the body cylinder. By retreating the writing lead greatly, the above-mentioned rotor is pushed upwards, and the projection of the rotor passes over the vertical projection formed at the above-mentioned cam part in the body cylinder and falls into the next vertical recess via the above-mentioned slope, to thereby rotate the rotor. In conjunction with the rotation of the above-mentioned rotor, the writing lead is rotationally driven.

According to the above-mentioned mechanical pencil, when the rotor is rotated, there is a problem in that the writing lead needs to have a large enough retreat stroke to allow the projection on the rotor side to pass over the vertical projection formed in the body cylinder. For this reason, in the case where the lead is partially worn due to the writing, a particular operation is required to apply the pressure which is greater than the usual writing pressure to the writing lead to retreat the rotor within the body cylinder, so that the projection on the rotor side may pass over the above-mentioned vertical projection formed in the body cylinder. Since it is necessary to carry out the operation relatively frequently each time the lead wears partially, there remains a problem of reduction in writing efficiency.

Then, in order to solve the problem with the mechanical pencil disclosed in patent documents 1 and 2 above, the applicant has filed an application (Japanese Patent Application No. 2006-156252) for a mechanical pencil in which the writing lead is rotationally driven by way of slight retreat and advance action (hereinafter, referred to as cushion action) of the writing lead when writing.

In the mechanical pencil in accordance with the above-mentioned application, first and second cam faces are respectively formed at one end face and another end face of the rotor which is formed cylindrically. The above-mentioned first cam face is brought into abutment with and meshed with a first fixed cam face by the retreat action of the above-mentioned rotor by way of writing pressure. Further, the above-mentioned second cam face is brought into abutment with and meshed with a second fixed cam face by the advance action of the rotor by releasing the writing pressure.

It is arranged that the above-mentioned cams reciprocatingly mesh with each other so as to rotate the rotor step by step in one direction and the rotational motion is transmitted to the writing lead through the chuck which grips the writing lead.

According to the above-mentioned structure, by setting an amount of retreat (amount of cushion action) of the writing lead when writing to around 0.05 to 0.5 mm, it is possible to rotationally drive the writing lead step by step, to thereby provide a mechanical pencil which does not reduce the writing efficiency but is excellent in practice.

Incidentally, in the mechanical pencil with the above-mentioned structure, since the writing lead causes the above-mentioned cushion action when writing, it has been confirmed that the inventors' trial production and verification result show that a particular sense of uncomforting occurs. In particular, in the case where a coil-spring member is used which causes the above-mentioned rotor to move forward by releasing the writing pressure, there often arises a feel of "clatter" in the cushion action of the writing lead. Further, there also arises a feel of "click" in the return action by the above-mentioned spring member.

The reason may be that when a certain load (writing pressure) is applied to the writing lead, there arises the cushion action suddenly. Further, a speed of the return action by the above-mentioned spring member when the writing pressure is released is high. For this reason, there arises an action in which the tip (writing lead) of the pencil follows the writing side at the moment when the pencil is taken off the writing side. Therefore, when writing operations, such as so-called jump, release, etc., are carried out, there arises a phenomenon that the writing does not finish in a desired position where the tip of the pencil is supposed to be taken off. It is thought that these may synergistically cause the above-mentioned particular sense of uncomforting.

In order to reduce the above-mentioned particular sense of uncomforting, it has been confirmed that improvement effects are somewhat obtained by devising the pencil, such as suitably selecting a spring constant, changing a set load etc. However, it is difficult to obtain a sufficient effect of reduction in the above-mentioned sense of uncomforting in a range of such devise.

The present invention arises in view of the above-mentioned problems with the mechanical pencil which rotationally drives the writing lead by way of the cushion action, and aims at providing the mechanical pencil which can effectively reduce the above-mentioned sense of uncomforting generated in conjunction with the above-mentioned cushion action.

Means to Solve the Problems

The mechanical pencil in accordance with the present invention made in order to solve the above-mentioned problems is a mechanical pencil which is arranged such that a chuck provided in a body cylinder reciprocates so as to grasp and release a writing lead to inch the above-mentioned writing lead forward, in which the above-mentioned chuck is held within the above-mentioned body cylinder so as to be rotatable about an axis in a situation where the chuck grasps the above-mentioned writing lead, a rotational drive mechanism is provided where a rotor is retreated and moved forward by writing pressure of the above-mentioned writing lead through the above-mentioned chuck so that the above-mentioned rotor is rotationally driven, and rotational motion of the above-mentioned rotor is transmitted to the above-mentioned writing lead through the above-mentioned chuck, characterized in that a sticky medium is interposed between a movable member which moves together with the above-mentioned writing lead in an axial direction and a stationary member facing a movable surface of the above-mentioned movable member so that the above-mentioned sticky medium provides retreat operation and forward movement of the above-mentioned writing lead with a damper function.

In this case, it is arranged that sticky grease is preferably used as the above-mentioned sticky medium.

A preferred embodiment of the above-mentioned rotational drive mechanism is such that the rotor which constitutes the rotational drive mechanism is formed into the shape of a ring, first and second cam faces are respectively formed at one end face and another end face of the rotor in an axial direction, and first and second fixed cam faces are arranged on the above-mentioned body cylinder side so as to face the above-mentioned first and second cam faces, respectively, wherein the first cam face in the above-mentioned ring-shaped rotor is brought into abutment with and meshed with the above-mentioned first fixed cam face by retreat operation of the above-mentioned chuck byway of the above-mentioned writing pressure, and the second cam face in the above-mentioned ring-shaped rotor is brought into abutment with and meshed with the above-mentioned second fixed cam face by releasing the above-mentioned writing pressure, and wherein the second cam face on the above-mentioned rotor side and the above-mentioned second fixed cam face are arranged to have a half-phase shifted relationship with respect to one tooth of a cam in the axial direction in a situation where the first cam face on the above-mentioned rotor side is meshed with the above-mentioned first fixed cam face, and the first cam face on the above-mentioned rotor side and the above-mentioned first fixed cam face are arranged to have the half-phase shifted relationship with respect to one tooth of the cam in the axial direction in a situation where the second cam face on the above-mentioned rotor side is meshed with the above-mentioned second fixed cam face.

In this case, it is desirable that a spring member is provided which biases the second cam face in the above-mentioned ring-shaped rotor into abutment with the above-mentioned second fixed cam face and brings the second cam face and the second fixed cam face to mesh with each other in a situation where the above-mentioned writing pressure is released.

Furthermore, in addition to the above-described structure, it is desirable that a torque canceller which is formed cylindrically and generates a slide between itself and an rear end portion of the above-mentioned rotor is interposed between the rear end portion of the above-mentioned rotor and the above-mentioned spring member so as to prevent the rotational motion of the above-mentioned rotor from being transmitted to the above-mentioned spring member.

In this case, in a preferred embodiment, it may be arranged that the above-mentioned torque canceller is used as the above-mentioned movable member which moves together with the writing lead in the axial direction so that the torque canceller acts as a part of above-mentioned damper function at the same time.

Effect of the Invention

According to the above-described mechanical pencil in accordance with the present invention, with application of the writing pressure, the rotor reciprocates in the axial direction and is rotationally driven, so that the rotational motion of the above-mentioned rotor is transmitted to the writing lead through the chuck. Thus, it is possible to prevent the local abrasion of the writing lead according to the progress of the writing and to solve the problem that the thickness of a drawn line and the boldness of the drawn line may change badly.

In addition, since it is arranged that by means of the sticky medium represented by the sticky grease, the retreat operation and forward movement of the above-mentioned writing lead are provided with the damper function, there arises considerable viscous drag in a rapid axial movement of the writing lead, and the viscous drag becomes very small with respect to a load moving comparatively slowly. Thus, an impact when a tip of the pencil is brought into contact with the writing side can be effectively damped according to the writing pressure and writing speed.

Therefore, it is possible to solve the problems that there arises a feel of "clatter" during the cushion action, there arises a feel of "click" in return operation by the spring member, etc. Further, it is possible to provide the mechanical pencil in which generation of the above-mentioned particular sense of uncomforting when writing is effectively prevented.

DESCRIPTION OF REFERENCE NUMERALS AND SIGNS

Figure 1:
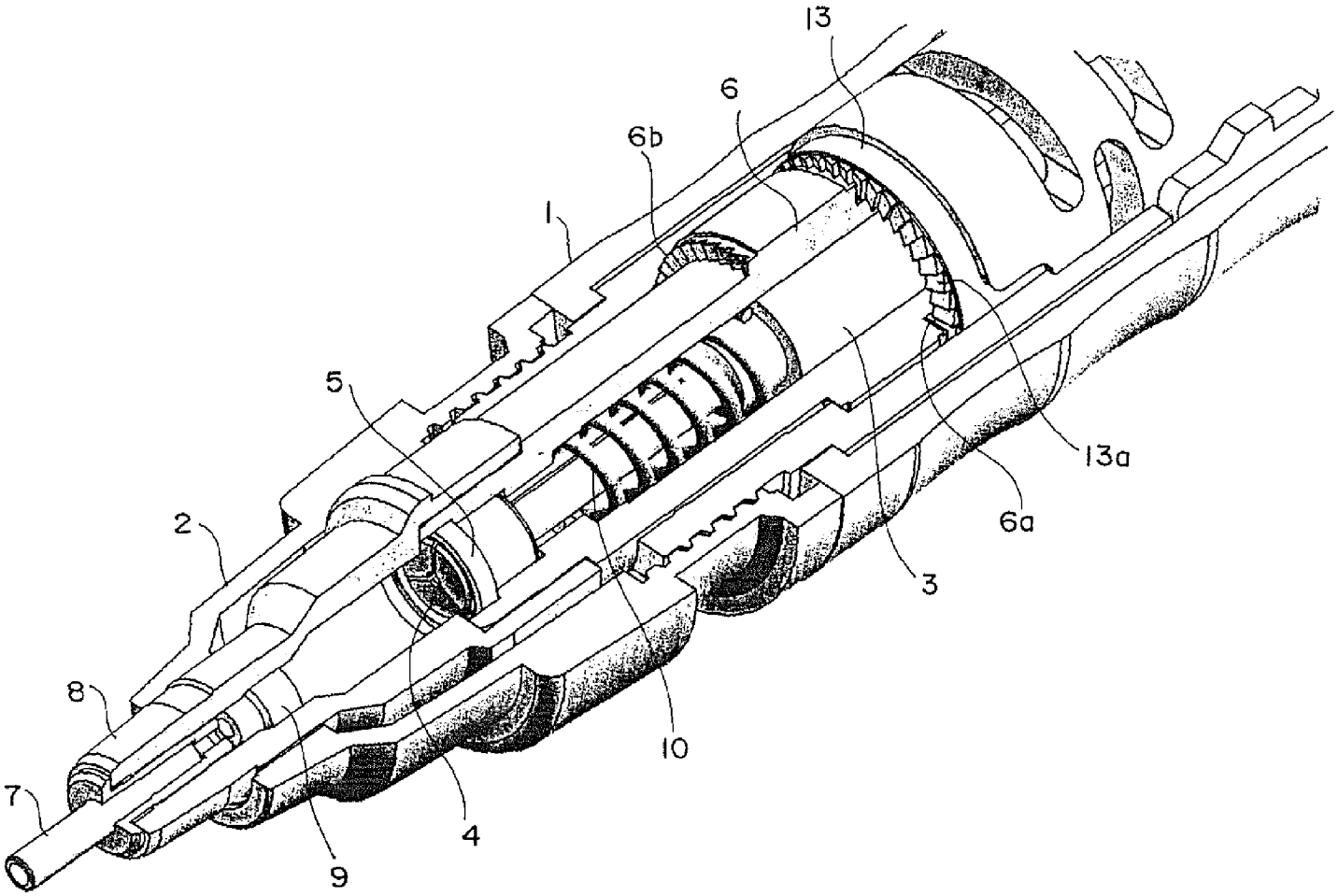
FIG. 1 is a perspective view of a first half part (partially broken-away) of a mechanical pencil in accordance with the present invention.

1: body cylinder
2: base
3: lead case
4: chuck
5: clamp
6: rotor
6*a*: first cam face
6*b*: second cam face
6*c*: indicator
7: pipe end
8: support member
9: holder chuck
10: return spring
13: upper cam formation member
13*a*: first fixed cam face
14: lower cam formation member
14*a*: second fixed cam face
16: stopper (stationary member)
17: torque canceller (movable member)
17*a*: circumferential surface (movable surface of movable member)
18: spring member
19: sticky grease (sticky medium)
21: knock bar
22: spring member
23: clip
26: knock cover

BEST MODE FOR CARRYING OUT THE INVENTION

Figure 2:
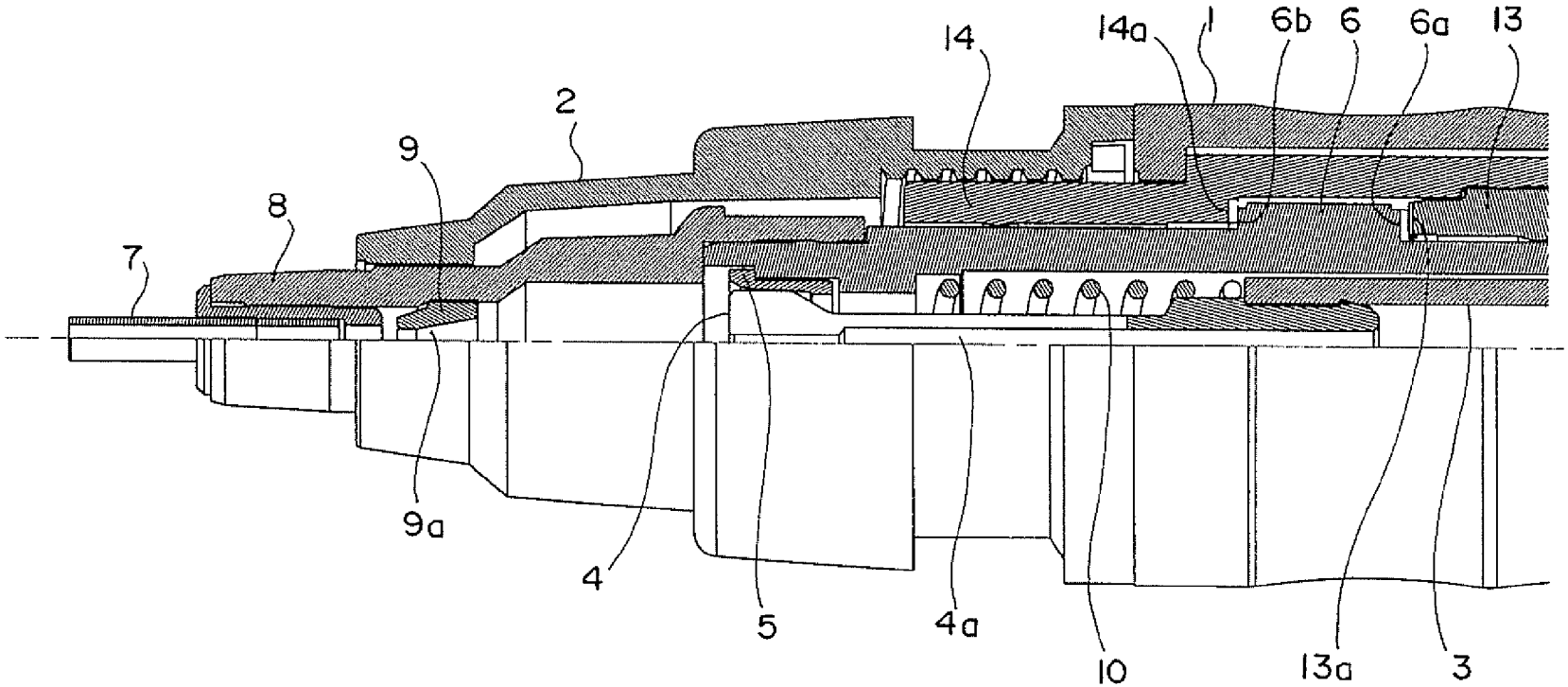
FIG. 2 is a fragmentary sectional side elevation similarly showing the first half part.

Hereinafter, a mechanical pencil in accordance with the present invention will be described with reference to the embodiments illustrated in the drawings. FIGS. 1 and 2 show a first half part of the mechanical pencil which is a principal part of the present invention. FIG. 1 is a perspective view showing its principal part, partially broken-away, and FIG. 2 is a side elevation where a left half portion is shown in section.

Reference numeral 1 denotes a body cylinder which constitutes the exterior, and reference numeral 2 indicates a base attached to a tip portion of the above-mentioned body cylinder 1. A cylindrical lead case 3 is accommodated coaxially in the center of the above-mentioned body cylinder 1, and a chuck 4 is connected with a tip portion of the lead case 3. The chuck 4 is mounted so that a through hole 4*a* is formed along an axis thereof, a tip portion is divided in three directions, and the divided tip portions are loosely fitted in a clamp 5 which is formed in the shape of a ring. The above-mentioned ring-shaped clamp 5 is mounted inside a tip portion of a rotor 6 which is arranged to cover the perimeter of the above-mentioned chuck 4 and which is formed cylindrically.

A pipe end 7 is arranged so as to project from the above-mentioned base 2, and an end portion of the pipe end 7 is fitted to an inner surface of a tip portion of a support member 8 as an intermediate member located in the above-mentioned base 2. The above-mentioned support member 8 is formed whose diameter gradually increases towards its end portion (rear end portion) side and whose cylindrical portion is integrally formed in the shape of a staircase. Fitted to its inner surface of the end portion is a circumferential surface at the tip portion of the above-mentioned rotor 6. Further, a holder chuck 9 made of rubber which has formed a through hole 9*a* in an axis portion is fitted to the circumferential surface at the support member 8 for supporting the above-mentioned pipe end 7.

According to the above-mentioned structure, a linear lead inserting hole is so formed as to pass via a through hole 4*a* formed in the chuck 4 and a through hole 9*a* formed along the axis of the above-mentioned holder chuck 9 from the lead case 3 to the above-mentioned pipe end 7. A writing lead (refill lead; not shown) is inserted into the linear lead inserting hole. Further, a return coil-spring 10 is arranged at a space between the above-mentioned rotor 6 and chuck 4. In addition, one end portion (rear end portion) of the above-mentioned return spring 10 is accommodated in abutment with an end face of the above-mentioned lead case 3 and another end portion (front end portion) of the above-mentioned return spring 10 is accommodated in abutment with an annular end face formed in the rotor 6. Therefore, the chuck 4 in the rotor 6 is biased to retreat by action of the above-mentioned return spring 10.

In the mechanical pencil shown in the drawings, when knock operation of a knock part (to be set forth later) which is disposed at a rear end portion of the body cylinder 1 is carried out, the above-mentioned lead case 3 advances in the body cylinder 1. The tip of the chuck 4 projects from a clamp 5 to cancel a grasp state of the writing lead. With cancellation of the above-mentioned knock operation, the lead case 3 and the chuck 4 retreat in the body cylinder 1 by the action of a return spring 10.

At this time, the writing lead is held in the through hole 9*a* formed at the holder chuck 9. In this situation, the chuck 4 retreats and a tip portion of the chuck 4 is accommodated in the above-mentioned clamp 5, thus the writing lead again comes into the grasp state. In other words, the writing lead is grasped and released when the chuck 4 moves back and forth by repeating the knock operation of the above-mentioned knock part, whereby the writing lead operates to inch forward from the chuck 4 stepwise.

The above-mentioned rotor 6 shown in FIG. 1 is formed such that a central part in the axial direction is increased in diameter to have a larger diameter portion in which a first cam face 6*a* is formed at one end face (rear end face) of the larger diameter portion, and a second cam face 6*b* is formed at the other end face (front end face) of the larger diameter portion. On the other hand, at the rear end portion of the above-mentioned rotor 6, a cylindrical upper cam formation member 13 is mounted in the body cylinder 1 so as to cover the rear end portion of the rotor 6. At the front end portion of the above-mentioned upper cam formation member 13, a fixed cam face (also referred to as "first fixed cam face") 13*a* is formed so as to face the first cam face 6*a* in the above-mentioned rotor 6.

Furthermore, although not shown in FIG. 1 but shown in FIG. 2, a cylindrical lower cam formation member 14 is mounted on the body cylinder 1 side so as to face the second cam face 6*b* in the above-mentioned rotor 6, and a fixed cam face (also referred to as "second fixed cam face") 14*a* is formed at the rear end portion in the axial direction. In addition, a relationship and mutual operation among the first and the second cam faces 6*a* and 6*b* which are formed at the above-mentioned rotor 6, the above-mentioned first fixed cam face 13*a*, and the second fixed cam face 14*a* will be described in detail later with reference to FIGS. 4 and 5.

Figure 3:
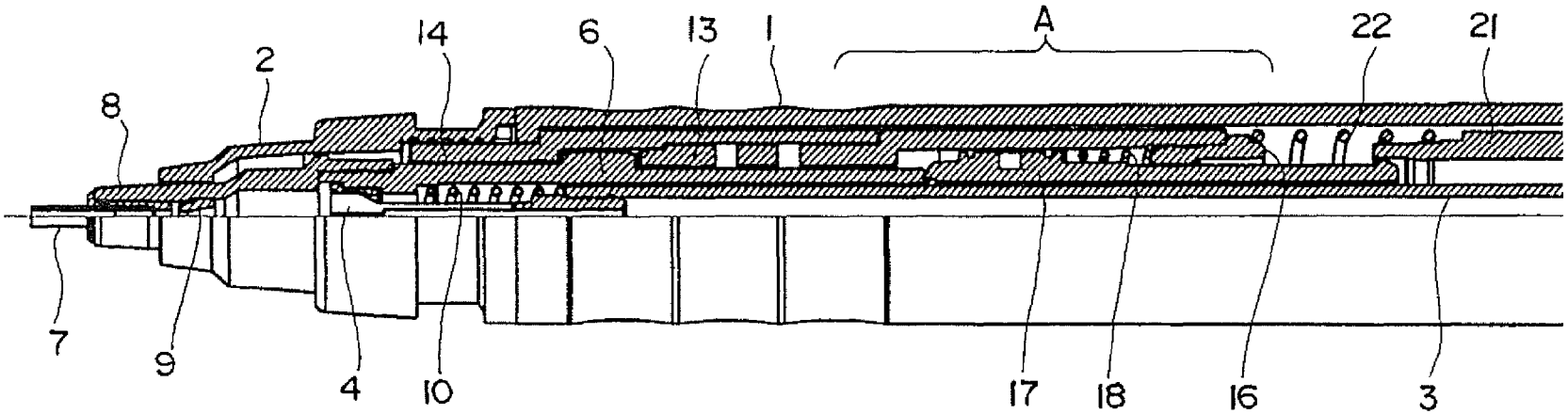
FIG. 3 is a fragmentary sectional side elevation further showing a rear portion of the mechanical pencil.

FIG. 3 further shows a farther portion of the mechanical pencil shown in FIGS. 1 and 2, and typical parts shown in FIGS. 1 and 2 are indicated by the same reference numerals. As shown in FIG. 3, a cylindrical stopper 16 is fitted to the rear end portion inside the upper cam formation member 13 which is formed cylindrically, and a coil-spring member 18 is provided between a front end portion of the stopper 16 and the torque canceller 17 which is formed cylindrically and can move in the axial direction.

It is arranged that the above-mentioned spring member 18 acts so as to bias forward the above-mentioned torque canceller 17 and the above-mentioned rotor 6 is pushed to move forward by the above-mentioned torque canceller 17 subjected to this bias force.

According to the above-mentioned structure, in a situation where the chuck 4 grasps the writing lead, the above-mentioned rotor 6 together with the chuck 4 is accommodated in the above-mentioned body cylinder 1 so as to be rotatable about the axis. Further, in a situation where the mechanical pencil is not in use (or not in writing state), the rotor 6 is biased forward by the action of the above-mentioned spring member 18 through the above-mentioned torque canceller 17, resulting in a situation shown in FIGS. 1 to 3.

On the other hand, when the mechanical pencil is used, i.e., when the writing pressure is applied to the writing lead (not shown) protruding from the pipe end 7, the above-mentioned chuck 4 retreats against the bias force of the spring member 18. According to this operation, the rotor 6 also retreats in the axial direction. Therefore, the first cam face 6*a* formed at the rotor 6 shown in FIGS. 1 and 2 engages with and meshes with the above-mentioned first fixed cam face 13*a*.

FIGS. 4(A) to 4(C) and FIGS. 5(D) and 5(E) are for explaining in order the fundamental operation of a rotational drive mechanism which rotationally drives the rotor 6 by the above-mentioned operation. In FIGS. 4 and 5, reference numeral 6 indicates the above-mentioned rotor which is schematically shown, and at one end face thereof (upper face in figures) the first cam face 6*a* having a continuous sawtooth shape along a circumferential direction is formed into the shape of a ring. Further, similarly, the second cam face 6*b* having a continuous sawtooth shape along the circumferential direction is formed into the shape of a ring at the other end face (lower face in figures) of the rotor 6.

On the other hand, as shown in FIGS. 4 and 5, the first fixed cam face 13*a* having a continuous sawtooth shape along the circumferential direction is also formed at a ring-shaped end face of the upper cam formation member 13, and the second fixed cam face 14*a* having a continuous sawtooth shape along the circumferential direction is also formed at a ring-shaped end face of the lower cam formation member 14.

The cam faces formed into the sawtooth shape along the circumferential direction at the first cam face 6*a* and the second cam face 6*b* formed at the rotor, the first fixed cam face 13*a* formed at the upper cam formation member 13, and the second fixed cam face 14*a* formed at the lower cam formation member 14 are each arranged to have substantially the same pitch. In addition, circle (O) drawn in the center of the rotor 6 illustrated in FIGS. 4 and 5 indicates an amount of rotational movement of the rotor 6.

Figure 4A:
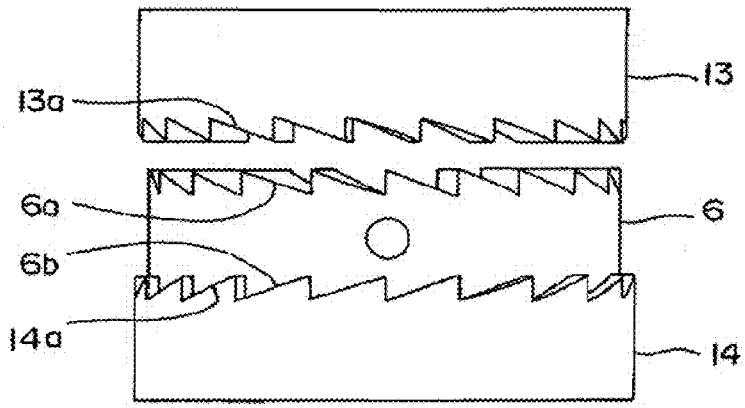
FIGS. 4A, 4B and 4C are schematic views for explaining, in order, rotational drive actions of a rotor employed in embodiments as shown in FIGS. 1 to 3.

FIG. 4(A) shows a relationship among the upper cam formation member 13, the rotor 6, and the lower cam formation member 14 in the situation where the mechanical pencil is not in use (or not in writing state). In this situation, by the bias force of the spring member 18 shown in FIG. 3, the second cam face 6*b* formed in the rotor 6 is brought into abutment with the second fixed cam face 14*a* side of the lower cam formation member 14 mounted at the body cylinder 1. At this time, the first cam face 6*a* on the above-mentioned rotor 6 side and the above-mentioned first fixed cam face 13*a* are arranged to have a half-phase (half-pitch) shifted relationship with respect to one tooth of the cam in the axial direction.

Figure 4B:
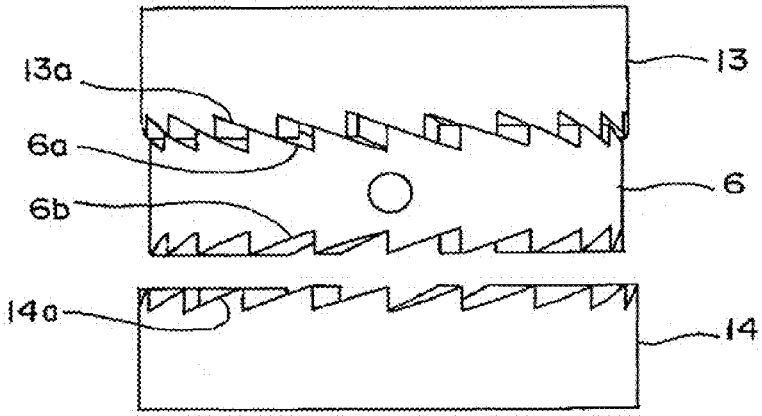

FIG. 4(B) shows an initial situation where the writing pressure is applied to the writing lead by use of the mechanical pencil. In this case, as described above, the rotor 6 compresses the above-mentioned spring member 18 and retreats in the axial direction while the chuck 4 retreats. Thus, the rotor 6 moves to the upper cam formation member 13 side mounted at the body cylinder 1.

Figure 4C:
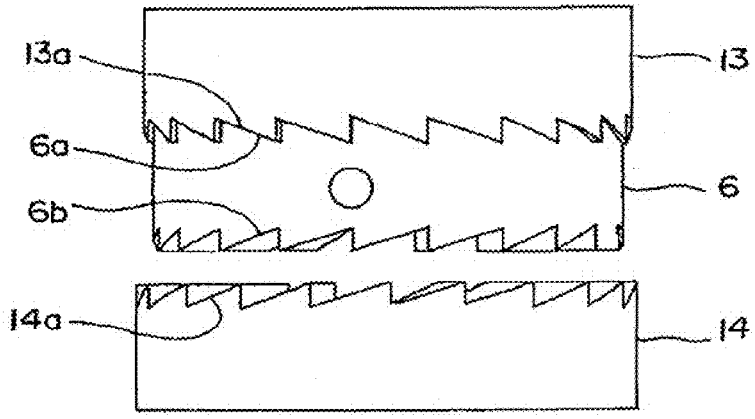

FIG. 4(C) shows a situation where the writing pressure is applied to the writing lead by use of the mechanical pencil and the rotor 6 comes into abutment with the upper cam formation member 13 side and retreats. In this case, the first cam face 6*a* formed at the rotor 6 meshes with the first fixed cam face 13*a* on the upper cam formation member 13 side. Thus, the rotor 6 is subjected to rotational drive corresponding to the half-phase (half-pitch) with respect to one tooth of the first cam face 6*a*. Further, in the situation shown in FIG. 4(C), the second cam face 6*b* on the above-mentioned rotor 6 side and the above-mentioned second fixed cam face 14*a* are arranged to have a half-phase (half-pitch) shifted relationship with respect to one tooth of the cam in the axial direction.

Figure 5D:
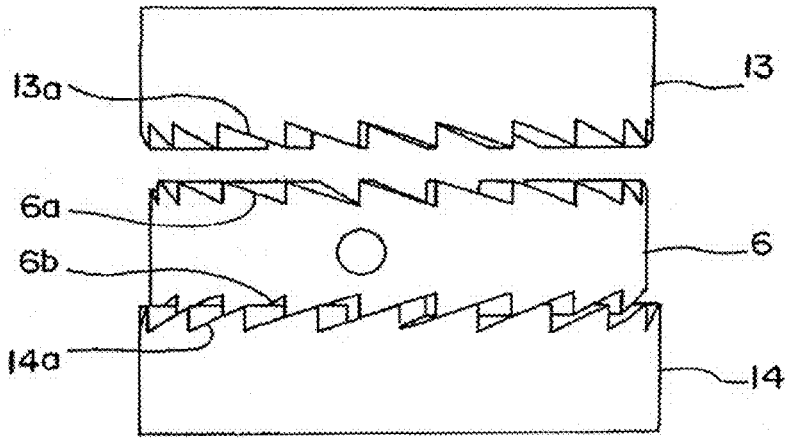
FIGS. 5D and 5E are schematic views for explaining the rotational drive actions of the rotor, following FIG. 4.

Next, FIG. 5(D) shows an initial situation where drawing with the mechanical pencil is finished and the writing pressure to the writing lead is released. In this case, the rotor 6 moves forward in the axial direction by action of the above-mentioned spring member 18. Thus, the rotor 6 moves to the lower cam formation member 14 side mounted at the body cylinder 1.

Figure 5E:
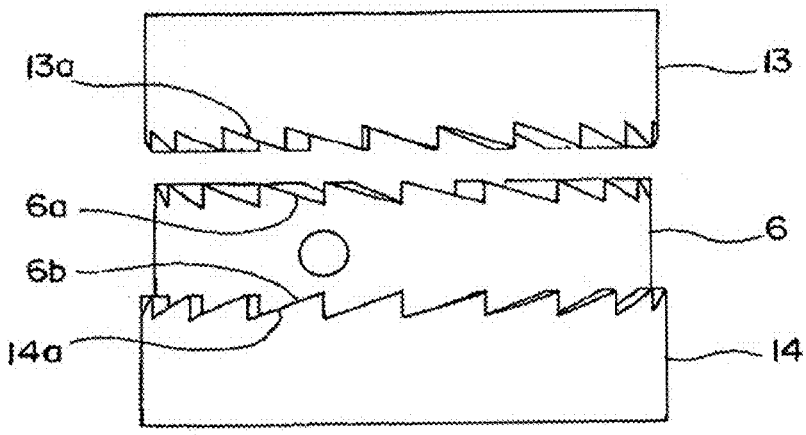

Furthermore, FIG. 5(E) shows a situation where the rotor 6 comes into abutment with the lower cam formation member 14 side and moves forward by action of the above-mentioned spring member 18. In this case, the second cam face 6*b* formed at the rotor 6 meshes with the second fixed cam face 14*a* on the lower cam formation member 14 side. Thus, the rotor 6 is subjected again to the rotational drive corresponding to the half-phase (half-pitch) of one tooth of the second cam face 6*b*.

Therefore, as shown by circle (O) drawn in the center of the rotor 6, according to reciprocating movement of the rotor (which is subjected to the writing pressure) in the axial direction, the rotor 6 is subjected to the rotational drive corresponding to one tooth (one pitch) of the first and second cam faces 6*a* and 6*b*, and the writing lead 10 grasped by the chuck 4 is rotationally driven through the chuck 4 similarly.

According to the mechanical pencil having the structure as described above, each time the writing causes the rotor 6 to reciprocate in the axial direction, the rotor is subjected to the rotational motion corresponding to one tooth of the cam. By repeating this operation, the writing lead is rotationally driven stepwise. Therefore, it is possible to prevent the writing lead from locally abrading as the writing proceeds, and it is also possible to solve the problem that the boldness of the drawn line and the thickness of the drawn line may change badly.

Furthermore, according to the mechanical pencil having the structure as described above, the pipe end 7 for guiding the writing lead and arranged to project from the base 2 is fitted to the tip portion of the above-mentioned rotor 6 through the support member 8 which functions as the intermediate member. Thus, as the above-mentioned chuck 4 retreats and moves forward in conjunction with the writing operation, the pipe end 7 moves in the same direction through the support member 8. Therefore, if the writing lead reciprocates slightly (cushion action) in conjunction with the writing operation, the pipe end for guiding the writing lead also moves in the same direction, whereby relative movement in the axial direction does not take place between the pipe end and the writing lead and an protrusion length of the writing lead from the pipe end can be kept constant.

Further, the pipe end 7 is connected with the above-mentioned rotor 6 through the support member 8. Thus, when the writing lead is subjected to the rotational movement, the pipe end is also subjected to the rotational movement similarly, so that the pipe end 7 and the writing lead rotate together.

Therefore, according to the mechanical pencil with the above-described structure, it is possible to solve the problem that, when writing, the protrusion length of the writing lead protruding from a base member or the pipe end changes each time and the user feels the sense of uncomforting. Further, the lead can be prevented from being broken due to the lead scraping at the pipe end, which is caused by the changes in the protrusion length of the writing lead from the pipe end and it is also possible to solve the problem that the paper surface is smeared by scraping of the lead.

In addition, with application of the bias force of the above-mentioned coil-like spring member 18, the cylindrical torque canceller 17, which moves forward the rotor 6, generates a slide between a front end face of the torque canceller 17 and a rear end face of the above-mentioned rotor 6 and acts so that the rotational motion of the above-mentioned rotor 6 generated by repetition of the writing action is prevented from being transmitted to the spring member 18.

In other words, since the torque canceller 17 formed cylindrically is interposed between the above-mentioned rotor and the spring member 18, the rotational motion of the above-mentioned rotor is prevented from being transmitted to the above-mentioned spring member, and it is possible to solve the problem that back torsion (spring torque) of the spring member 18 occurs and places an obstacle to rotation operation of the rotor 6.

Figure 6:
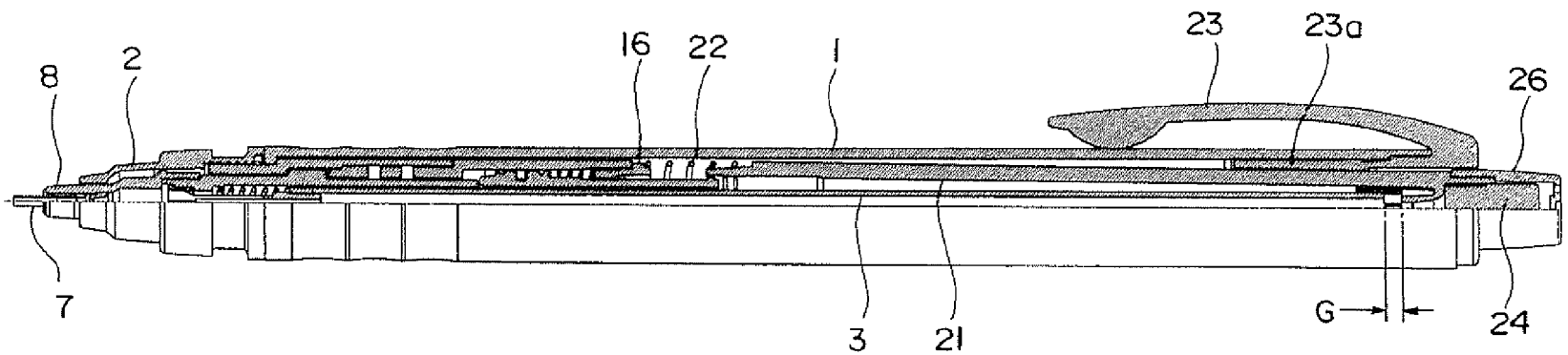
FIG. 6 is a fragmentary sectional side elevation showing the whole structure in the preferred embodiments shown in FIGS. 1 to 3.
Figure 7:
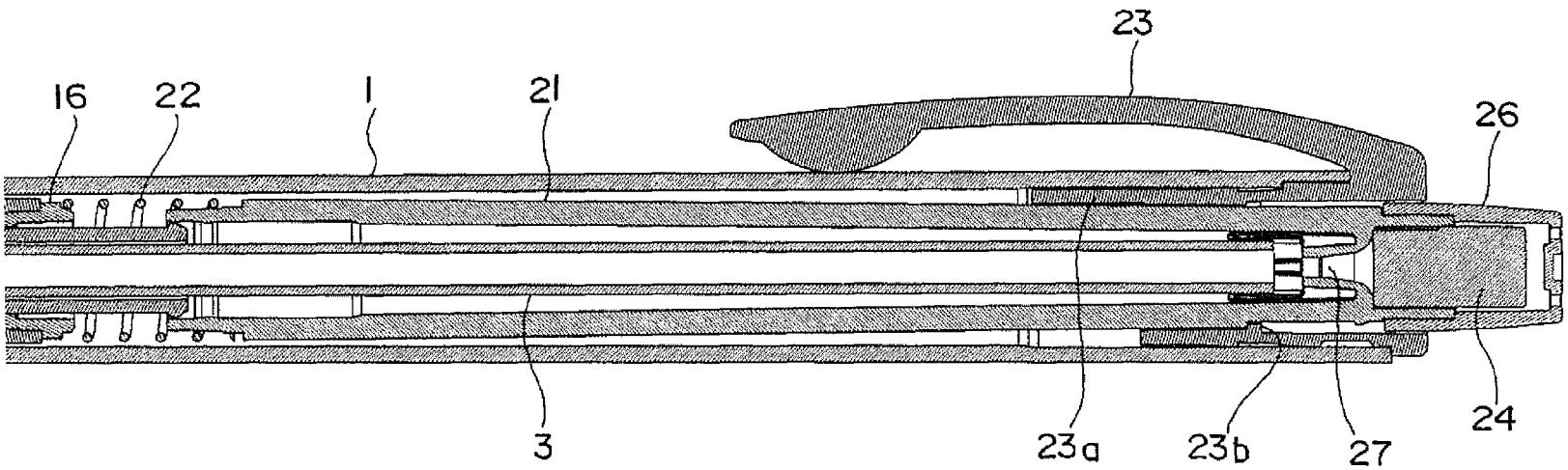
FIG. 7 is an enlarged sectional view similarly showing a second half part.

FIG. 6 shows the whole structure of the mechanical pencil provided with the above-mentioned function, and its second half is enlarged and shown in FIG. 7. Further, FIG. 6 illustrates a left half portion in section with a side elevation and FIG. 7 illustrates it in section. In FIGS. 6 and 7, like reference signs indicate like parts that are typically shown in each drawing as already described.

As shown in FIGS. 6 and 7, a knock bar 21 formed cylindrically is accommodated between the body cylinder 1 and the lead case 3 inside the rear end side of the body cylinder 1. The knock bar 21 is arranged to be biased rearward at its front end portion by a coil-spring member 22 arranged between a rear end portion of the above-mentioned stopper 16 and the knock bar itself. Further, it is arranged that a cylinder body 23*a* in which a clip 23 is integrally formed at a rear end portion of the body cylinder 1 is fitted into the body cylinder 1 and the above-mentioned knock bar 21 is prevented from protruding towards the rear end side of the body cylinder 1 by a step portion 23*b* formed inside the cylinder body 23*a* as shown in FIG. 7.

The rear end portion of the above-mentioned knock bar 21 is arranged to project rearward a little farther than a rear end portion of the above-mentioned cylinder body 23*a*, and an eraser 24 is accommodated in an inside space at the rear end portion of the above-mentioned knock bar 21. Further, the knock cover 26 which constitutes the knock part so as to cover the above-mentioned eraser 24 is detachably provided so as to cover a perimeter side of the rear end portion of the knock bar 21.

On the other hand, as shown in FIG. 7, a writing lead feeding hole 27 having a diameter smaller than an inner diameter of the knock bar 21 is formed immediately before the rear end portion in the knock bar 21. As shown in FIG. 6, it is arranged that a front end portion of the above-mentioned feeding hole 27 faces a rear end portion of the above-mentioned lead storage 3 to have a small gap G. In other words, in this embodiment, the lead storage 3 is not mechanically connected with the above-mentioned knock bar 21 but separated in the position of the above-mentioned gap G.

In the above structure, when the knock operation of the above-mentioned knock cover 26 is carried out, it acts so that the front end portion of the above-mentioned feeding hole 27 comes into abutment with the rear end portion of the lead storage 3 through the knock bar 21 so as to inch the lead storage 3 forward, maintaining the abutment. Thereby, as described above, the chuck 4 moves forward and operates to inch the writing lead out of the pipe end 7. Then, on releasing the above-mentioned knock operation, the knock bar 21 is retreated by action of the spring member 22, and the knock bar 21 is held by the step portion 23*b* formed inside the cylinder body 23*a* which supports the clip 23.

According to the structure as described above, since the gap G is formed between the front end portion of the writing lead feeding hole 27 formed on the rear end portion side of the knock bar 21 and the rear end portion of the above-mentioned lead storage 3, the rear end portion of the lead case 3 does not impact on the front end portion of the above-mentioned feeding hole 27 in the case of the retreat operation of the chuck 4 and the lead case 3 when writing. In the presence of the above-mentioned gap G, the rotation operation of the lead case 3 caused by the above-mentioned rotational drive mechanism is not transmitted to the knock cover 26 side.

In other words, even if the knock cover 26 is rotated by a finger etc., the rotation operation is not transmitted to the above-mentioned rotational drive mechanism through the lead case 3, and it is possible to solve the problem that excessive rotation of the knock cover 26 may place an obstacle to the rotational drive mechanism.

Further, formation of the above-mentioned gap G can solve the problem that the function of the above-mentioned rotational drive mechanism for rotationally driving the writing lead is stopped when the above-mentioned knock cover 26 projecting at the rear end portion of the body cylinder is in contact with something.

Incidentally, in the mechanical pencil with the above-described structure, the rotor is rotated by way of the cushion action of the writing lead subjected to the writing pressure so that the writing lead is rotationally driven in one direction. Thus, as already described, there often arises a feel of "clatter" or a feel of "click" in conjunction with the cushion action, leaving a problem in bad feeling.

Figure 8:
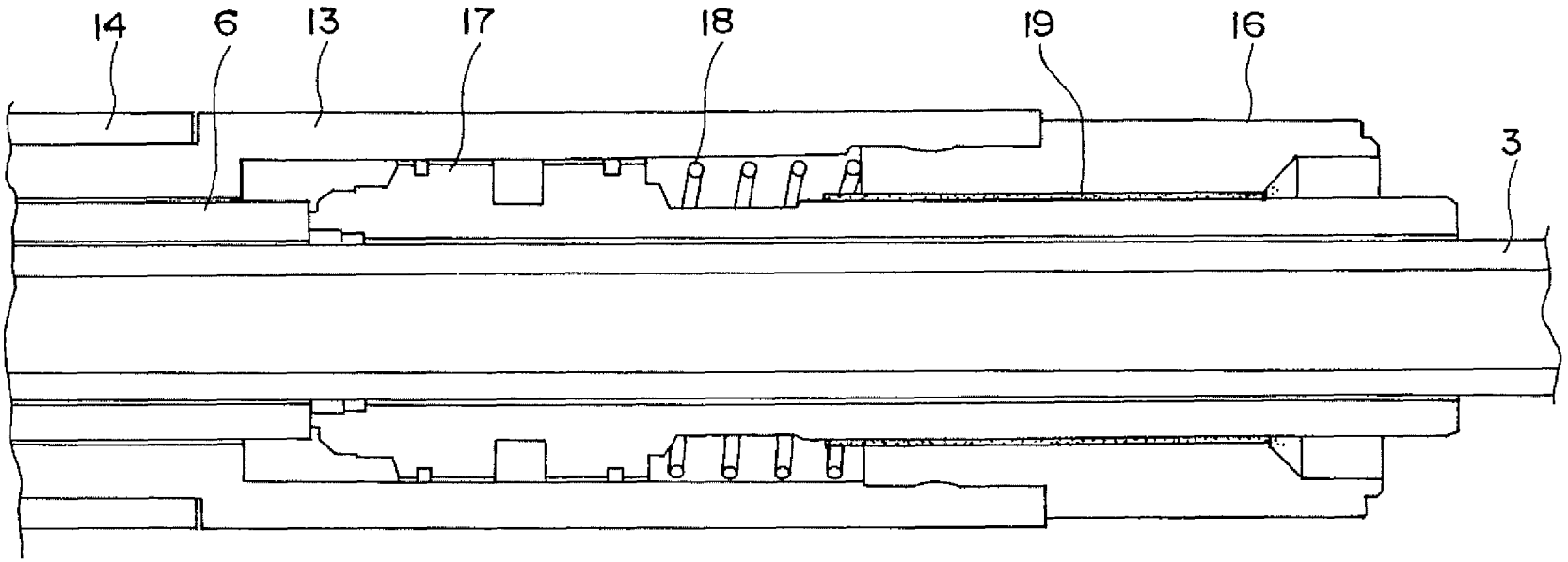
FIG. 8 is an enlarged sectional view showing a damper function unit formed at part A in FIG. 3.

FIGS. 8 and 9 show one example of an action for solving the above-mentioned problem, and show an example in which a damper function is provided between the already described stopper 16 and torque canceller 17. In other words, FIG. 8 illustrates part A, shown in FIG. 3, by means of an enlarged sectional view, in which like parts are given like reference signs, respectively. In addition, the body cylinder 1 which constitutes an outline is not shown in FIG. 8. Further, by means of a perspective view, FIG. 9 illustrates a partial structure including the torque canceller 17, the spring member 18, and a stopper 16 which are shown in FIG. 8.

As shown in FIG. 8, the stopper 16 which is formed cylindrically is fitted to the rear end portion of the upper cam formation member 13, and the torque canceller 17 which is formed cylindrically is arranged to slide in the axial direction at an inner circumference of the above-mentioned stopper 16. Further, it is arranged that the spring member 18 is interposed between the stopper 16 and the torque canceller 17 so that the spring member 18 may bias the torque canceller 17 to the rotor 6 side.

Therefore, in the above-mentioned structure, the torque canceller 17 functions as a movable member which moves in the axial direction together with the writing lead with application of the writing pressure of the writing lead. The stopper 16 functions as a stationary member which faces a movable surface of the above-mentioned movable member (torque canceller 17).

As shown in FIGS. 8 and 9, a sticky medium indicated by reference numeral 19 is interposed between the movable surface of the above-mentioned movable member (i.e., a circumferential surface 17*a* of the torque canceller 17) and the above-mentioned stationary member facing it (i.e., the stopper 16), to thereby constitute the damper function.

Figure 9B:
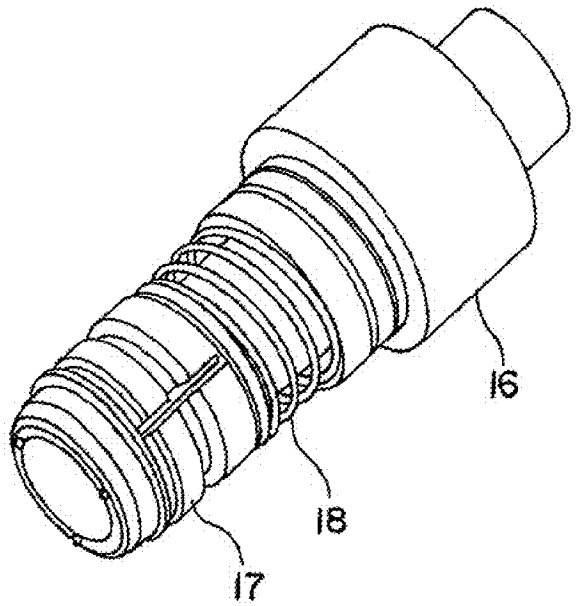
FIGS. 9A and 9B are perspective views similarly showing elements of the damper function unit.
Figure 9A:
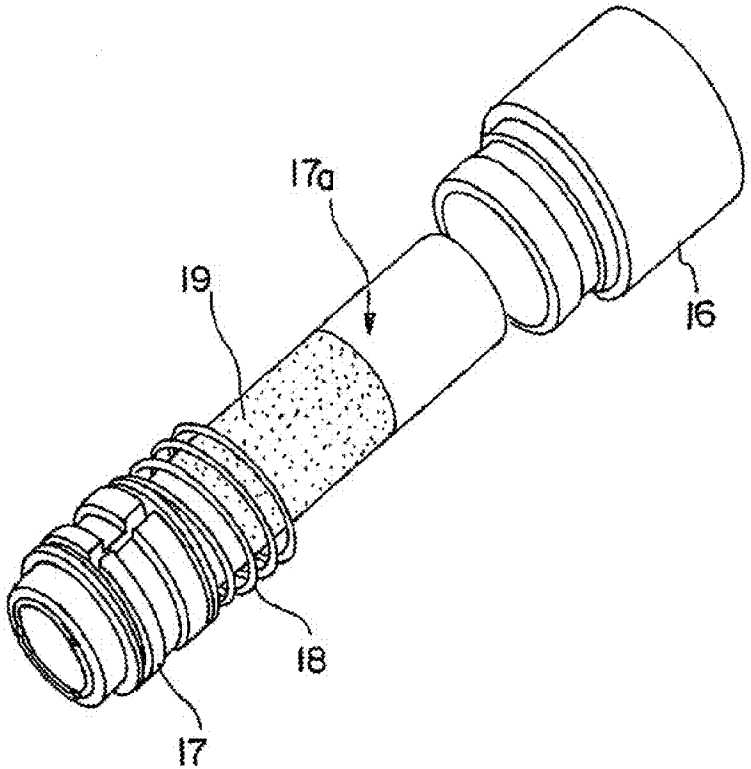

As the above-mentioned sticky medium 19, sticky grease is preferably used. In the step of assembling the mechanical pencil, as shown in FIG. 9(A), it is applied along the circumferential surface 17*a* of the torque canceller 17. In this situation, as shown in FIG. 9(B), the torque canceller 17 is provided at the inner circumference of the stopper 16 so that the sticky grease can be interposed between the torque canceller 17 and the stopper 16.

According to the above-mentioned structure, the retreat operation and forward movement of the above-mentioned writing lead in conjunction with the writing operation may be provided with the damper function. In this case, as the above-mentioned sticky grease used in the above-mentioned preferred embodiment, it is desirable to use one having a consistency (or cone penetration) in a range from 100 to 400. As the above-mentioned sticky grease, "Shin-Etsu silicone grease" (trade name; available from Shin-Etsu Chemical Co., Ltd.), product numbers: G330 to G334, G340 to G342, G351 to G353, and G631 to G633 can be suitably used, for example.

Thus, as already described in the paragraph of "Effect of the Invention", a large amount of viscous drag is applied to a rapid axial movement of the writing lead, and a load moving comparatively slowly is provided with the damper function in which the viscous drag becomes very small.

Therefore, the impact when a tip of the pencil is brought into contact with the writing side can be effectively damped according to the writing pressure and writing speed. It is possible to solve the problems that there arises a feel of "clatter" during the cushion action of the writing lead, there arises a feel of "click" in return operation by the spring member, etc. Further, it is possible to provide the mechanical pencil in which generation of a particular sense of uncomforting when writing is effectively prevented.

In addition, in the preferred embodiments as described above, it is arranged that the torque canceller 17 is used as the movable member which moves in the axial direction together with the writing lead with application of the writing pressure of the writing lead, the stopper 16 is used as the stationary member facing the movable surface of the above-mentioned movable member, and the sticky grease is interposed between them. However, when it is arranged that the above-mentioned rotor 6 is used as the above-mentioned movable member, the above-mentioned upper cam formation member 13 or the lower cam formation member 14 is used as the stationary member, and the sticky grease is interposed between them, it is possible to obtain the same operational effect.

Further, in the above description, although the example is illustrated by using the sticky grease as the sticky medium which allows the damper function, it is possible to use the sticky media, such as highly viscous oil (e.g. castor oil), liquid rubber, low molecular-weight resin, clay, etc., instead.

The invention claimed is:

1. A mechanical pencil arranged to grasp and release a writing lead by reciprocation of a chuck provided in a body cylinder so as to inch said writing lead forward, in which said chuck is held within said body cylinder so as to be rotatable about an axis in a situation where said chuck grasps said writing lead, a rotational drive mechanism is provided where a rotor is retreated and moved forward by writing pressure of said writing lead through said chuck so that said rotor is rotationally driven, and rotational motion of said rotor is transmitted to said writing lead through said chuck, characterized in that a sticky medium is interposed between a movable member which moves together with said writing lead in an axial direction with application of the writing pressure of said writing lead and a stationary member facing a movable surface of said movable member so that said sticky medium provides retreat operation and forward movement of said writing lead with a damper function.

2. The mechanical pencil as claimed in claim 1, characterized in that said sticky medium is sticky grease.

3. The mechanical pencil as claimed in claim 1, characterized in that said rotor which constitutes said rotational drive mechanism is formed into the shape of a ring, first and second cam faces are respectively formed at one end face and another end face of the rotor in an axial direction, and first and second fixed cam faces are provided which are arranged on said body cylinder side so as to face said first and second cam faces, respectively, the first cam face in said ring-shaped rotor is brought into abutment with and meshed with said first fixed cam face by retreat operation of said chuck by way of said writing pressure, and the second cam face in said ring-shaped rotor is brought into abutment with and meshed with said second fixed cam face by releasing said writing pressure, and the second cam face on said rotor side and said second fixed cam face are arranged to have a half-phase shifted relationship with respect to one tooth of a cam in the axial direction in a situation where the first cam face on said rotor side is meshed with said first fixed cam face, and the first cam face on said rotor side and said first fixed cam face are arranged to have the half-phase shifted relationship with respect to one tooth of the cam in the axial direction in a situation where the second cam face on said rotor side is meshed with said second fixed cam face.

4. The mechanical pencil as claimed in claim 3, characterized by comprising a spring member for biasing the second cam face of said ring-shaped rotor into abutment with said second fixed cam face and bringing the second cam face and the second fixed cam face to mesh with each other in a situation where said writing pressure is released.

5. The mechanical pencil as claimed in claim 4, characterized in that a torque canceller which is formed cylindrically and generates a slide between itself and a rear end portion of said rotor is interposed between the rear end portion of said rotor and said spring member so as to prevent the rotational motion of said rotor from being transmitted to said spring member.

6. The mechanical pencil as claimed in any one of claims 1 to 5, characterized by being arranged that said torque canceller is used as said movable member which moves together with the writing lead in the axial direction, and said torque canceller also plays a part of role of said damper function.

* * * * *